US011565925B1

(12) United States Patent
Schuettpelz

(10) Patent No.: US 11,565,925 B1
(45) Date of Patent: Jan. 31, 2023

(54) MANHOLE COVER TOOL

(71) Applicant: Kevin J. Schuettpelz, Kaukauna, WI (US)

(72) Inventor: Kevin J. Schuettpelz, Kaukauna, WI (US)

( * ) Notice: Subject to any disclaimer, the term of this patent is extended or adjusted under 35 U.S.C. 154(b) by 0 days.

(21) Appl. No.: 17/824,443

(22) Filed: May 25, 2022

(51) Int. Cl.
*B66F 19/00* (2006.01)
*B66F 15/00* (2006.01)
*B25D 1/04* (2006.01)

(52) U.S. Cl.
CPC ..... *B66F 19/005* (2013.01); *B25D 1/045* (2013.01); *B66F 15/00* (2013.01)

(58) Field of Classification Search
CPC .... B25D 1/045; B25D 1/02; B25D 2250/105; B25D 1/04; B66F 15/00; B66F 19/005; B25F 1/00; A62B 3/005
See application file for complete search history.

(56) References Cited

U.S. PATENT DOCUMENTS 1,205,280 A * 11/1916 Sommer ..... A62B 5/00 403/379.5
5,865,425 A * 2/1999 Meadows ..... B66F 15/00 254/26 R
D438,082 S * 2/2001 Stegner ..... D8/78
2005/0017225 A1* 1/2005 Sleiman ..... B25D 1/045 254/26 E
2009/0050861 A1* 2/2009 Noah ..... B25D 1/045 254/26 E
2021/0323138 A1* 10/2021 Villarino, III ..... B25D 1/02

OTHER PUBLICATIONS

Doug Meadows Company manhole cover extractors (Year: 2022).*
Owner Unknown & Not the Applicant, "Hookaroon", Applicant provided image of publicly available product in existence at least as early as May 24, 2022, 1 page filed herewith.
Owner Unknown & Not the Applicant, "Rolling Head Pry Bar", Applicant provided image of publicly available product in existence at least as early as May 24, 2022, 3 pages filed herewith.
Owner Unknown & Not the Applicant, "Name of product/brand unknown", Applicant provided image of publicly available product in existence at least as early as May 24, 2022, 1 page filed herewith.

* cited by examiner

*Primary Examiner* — Mahdi H Nejad
(74) *Attorney, Agent, or Firm* — Davis & Kuelthau, S.C.

(57) ABSTRACT

A tool joinable with a handle. The tool includes a body, the body includes a middle area configured to be joinable to the handle. The front end of the body includes a toe extending away from the middle area. The toe includes a first vertical thickness and a second vertical thickness less than the first vertical thickness for a length of the toe extending away from the middle area. The back end of the body can include a heal pad extending away from the middle area and to create a heal gap between a bottom surface of the heal pad and the second portion of the bottom edge defined by the middle area. The tool can include a fulcrum joined to the body and defining a fulcrum portion of the bottom edge with the fulcrum projecting away from the top edge.

25 Claims, 5 Drawing Sheets

MANHOLE COVER TOOL

TECHNICAL FIELD

This invention generally relates to tools to assist in mechanical movement of parts, and more particularly, to a tool that can be combined with a handle to enhance mechanical leverage and assist in more ergonomically moving a heavy object from one place to another, and preferably more safely and with less overall effort too.

BACKGROUND

There are at least three prior existing tools in the art to try and meet the need of moving a heavy object, like a manhole cover, in particular, removing and moving the manhole cover from its seated location over a manhole. However, each of these tools has limitations on its effectiveness, and none provide the various combination of benefits my tool can provide, especially when it comes to being able to more safely, and with less physical effort, and more ergonomically, remove the manhole cover from the manhole and then move it from over the manhole to adjacent to the manhole and not impeding access to the manhole. Thus, there is a need to address one or more of the deficiencies in the art to better aid in achieving more desirable requirements and avoiding negative ones, for a tool like mine, especially when used to remove a manhole cover, and preferably in a way that is more consistent and reliable for such a tool.

SUMMARY

To address one or more deficiencies in the art and/or better achieve the desirable requirements for moving a manhole cover from a manhole, there is provided a tool joinable with a handle to aid in moving the manhole cover from the manhole. The tool includes a body extending from a front end to a back end and from a top edge to a bottom edge. The body further includes a middle area located between the front end and the back end and bounded by the top edge and the bottom edge, with the middle area configured to be joinable to the handle and the handle selectively securable to the body in a fixed relationship. The front end of the body includes a toe extending away from the middle area. The toe includes (i) a first vertical thickness equal to a middle vertical thickness of the middle area where the toe is joined to the middle area, and (ii) a second vertical thickness less than the first vertical thickness for a length of the toe extending away from the middle area. The back end of the body includes a heal pad extending away from the middle area with a first portion of the bottom edge defined by the heal pad being offset a first vertical distance from a second portion of the bottom edge defined by the middle area to create a heal gap between a bottom surface of the heal pad and an imaginary line formed by and extending parallel out from the second portion of the bottom edge defined by the middle area.

In other aspects, there is disclosed a tool joinable with a handle. The tool includes a body extending from a front end to a back end and from a top edge to a bottom edge. The body includes a middle area located between the front end and the back end and bounded by the top edge and the bottom edge, with the middle area configured to be joinable to the handle and the handle selectively securable to the body in a fixed relationship. The front end of the body includes a toe extending away from the middle area. The toe includes (i) a first vertical thickness equal to a middle vertical thickness of the middle area where the toe is joined to the middle area, and (ii) a second vertical thickness less than the first vertical thickness for a length of the toe extending away from the middle area. The back end of the body includes a heal pad extending away from the middle area with a first portion of the bottom edge defined by the heal pad being offset a first vertical distance from a second portion of the bottom edge defined by the middle area to create a heal gap between a bottom surface of the heal pad and an imaginary line formed by and extending parallel out from the second portion of the bottom edge defined by the middle area. The bottom edge is flat in an end-to-end dimension for essentially an entirety of the bottom edge except for the toe and a toe portion of the top edge having a concave upward shape. A fulcrum is joined to the body and defining a fulcrum portion of the bottom edge with the fulcrum projecting away from the top edge.

In yet other aspects, there is disclosed a tool joinable with a handle. The tool includes a body extending from a front end to a back end and from a top edge to a bottom edge. The body includes a middle area located between the front end and the back end and bounded by the top edge and the bottom edge, with the middle area configured to be joinable to the handle and the handle selectively securable to the body in a fixed relationship. The front end of the body includes a toe extending away from the middle area. The toe includes (i) a first vertical thickness equal to a middle vertical thickness of the middle area where the toe is joined to the middle area, and (ii) a second vertical thickness less than the first vertical thickness for a length of the toe extending away from the middle area. A fulcrum is joined to the body and defining a fulcrum portion of the bottom edge with the fulcrum projecting away from the top edge. The fulcrum portion is offset a second vertical distance from the second portion of the bottom edge defined by the middle area to create a fulcrum gap between a bottom surface of the fulcrum and the imaginary line formed by and extending parallel out from the middle area of the bottom edge.

Other aspects of the disclosure are directed to configurations and features for the tool body, tool middle area, tool toe, tool pad and/or tool fulcrum, each as more fully described herein.

BRIEF DESCRIPTION OF THE DRAWINGS

The invention may be more completely understood in consideration of the following detailed description of various features of the invention in connection with the accompanying drawings, in which.

Figure 1:
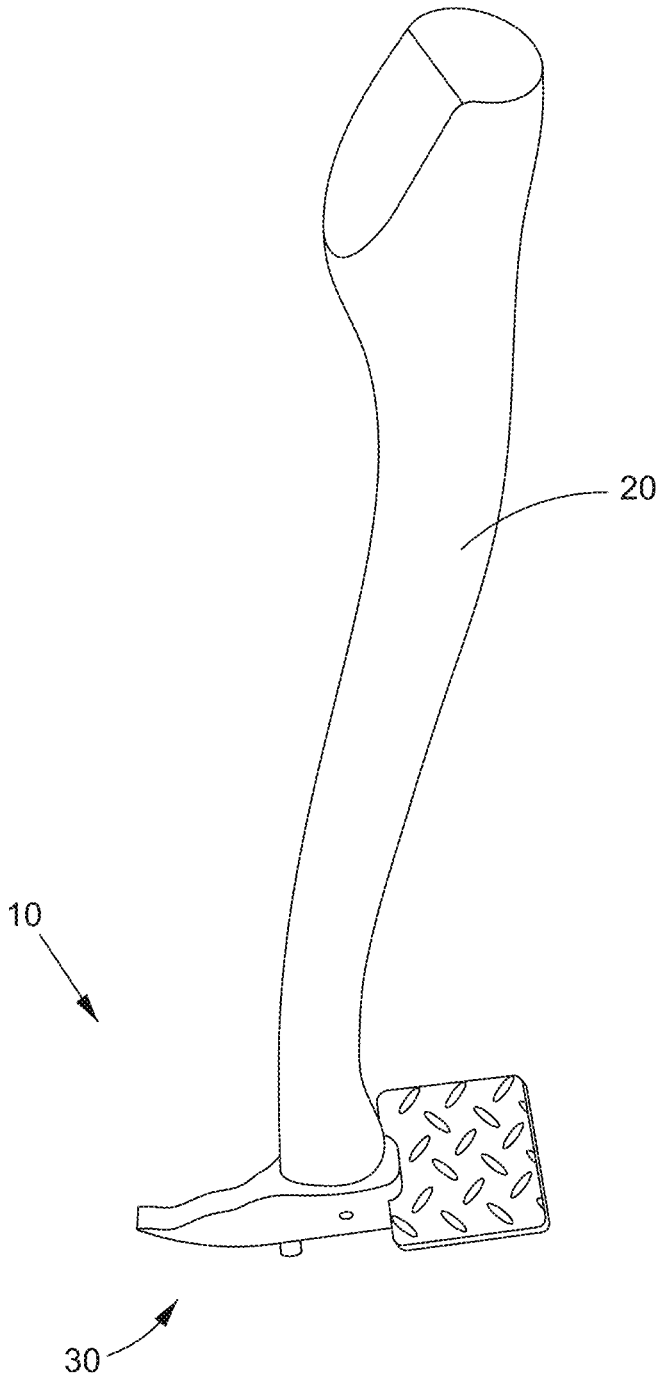
FIG. 1 is a perspective view of my innovative tool joined with a handle.

The drawings show some but not all embodiments. The elements depicted in the drawings are illustrative and not necessarily to scale, and the same (or similar) reference numbers denote the same (or similar) features throughout the drawings, though all the same (or similar) features are not always separately numbered to help avoid over numbering and obscuring what the drawings are disclosing.

DETAILED DESCRIPTION

Figure 2:
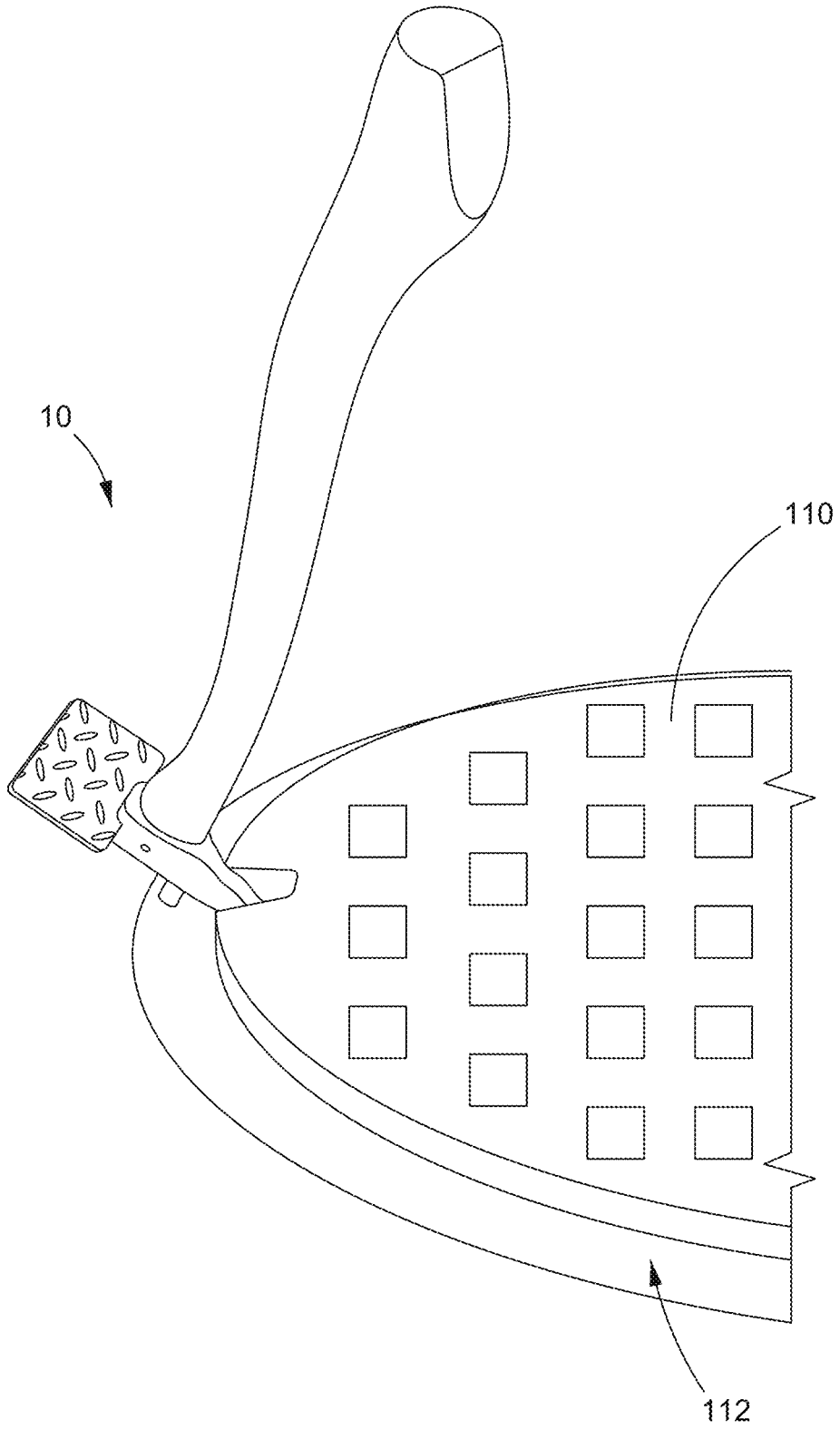
FIG. 2 is another perspective view of that in FIG. 1, and now also engaging a manhole cover to begin to remove the cover from a manhole.
Figure 3:
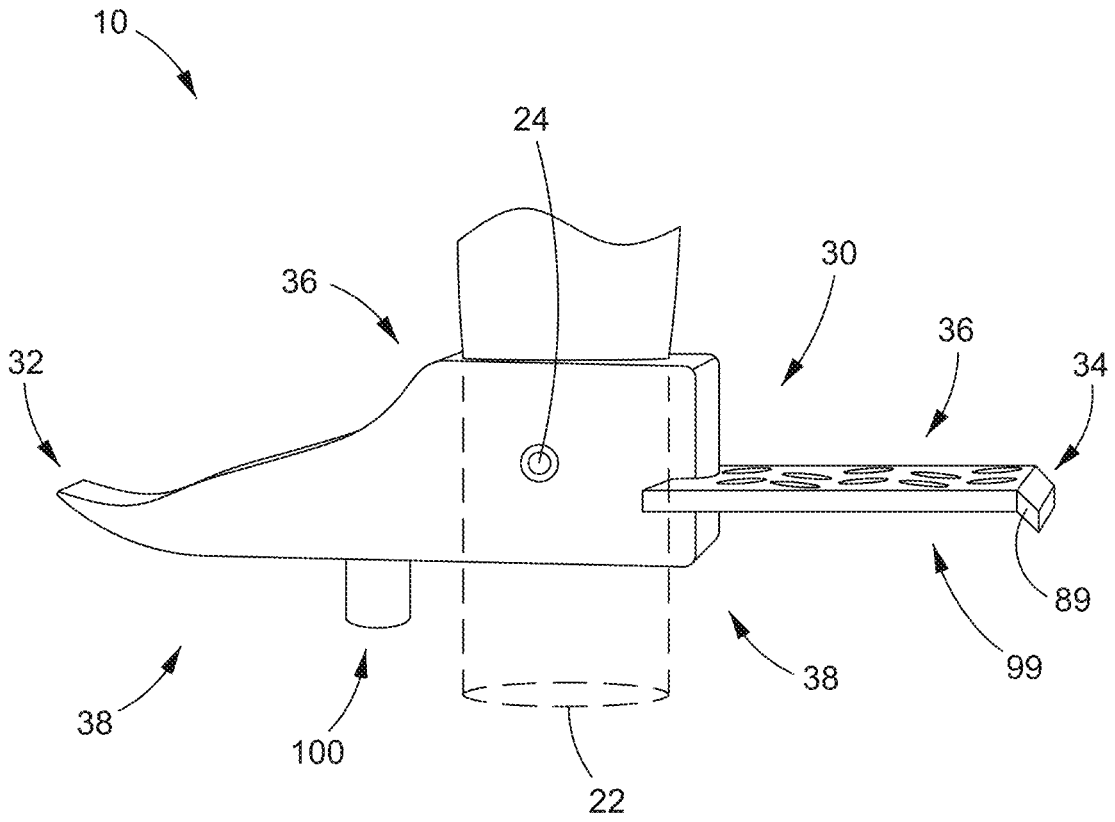
FIG. 3 is an enlarged perspective view of a portion of that in FIG. 1, and also depicting just in this figure an exemplary foot ledge.
Figure 4:
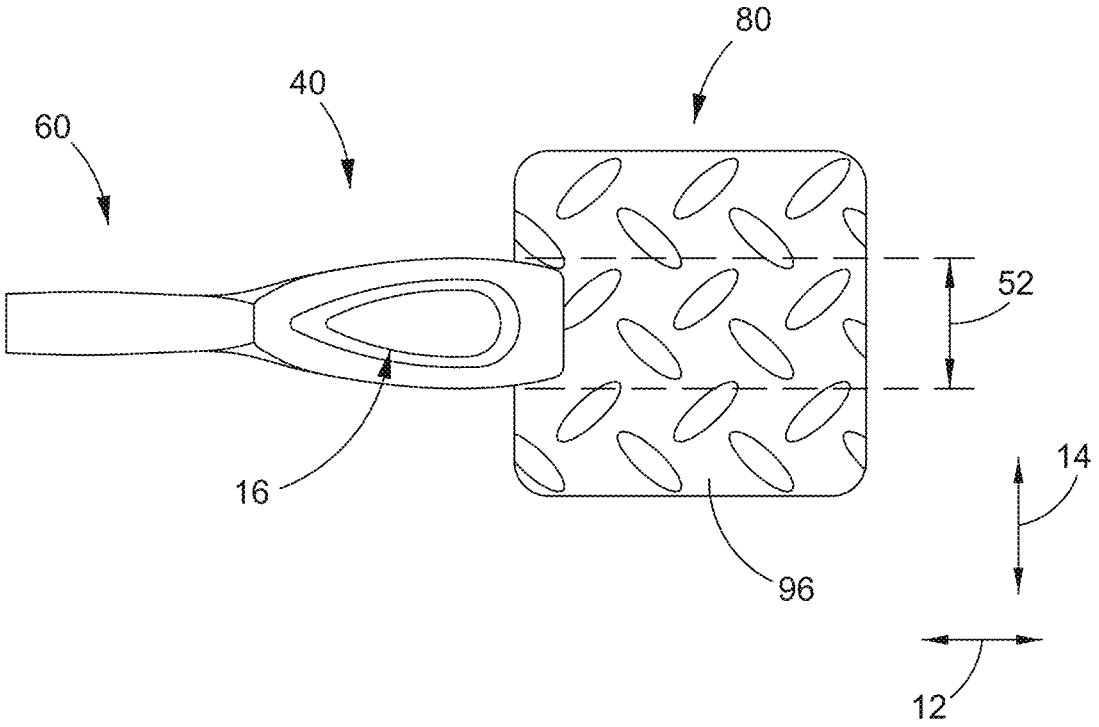
FIG. 4 is a top view of that in FIG. 3 (without the foot ledge)
Figure 5:
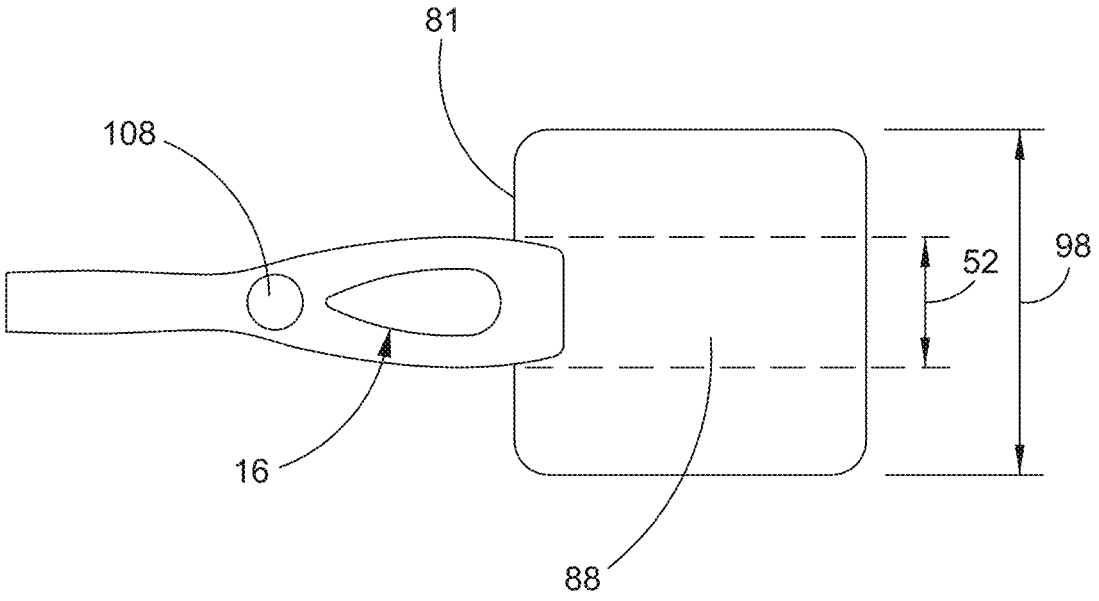
FIG. 5 is a bottom view of that in FIG. 3 (without the foot ledge)

In accordance with the practice of my innovative tool, as seen in the Figures, tool 10 is joinable with a handle 20 to aid in moving a manhole cover 110 from a manhole 112 (as seen in FIG. 2, for example, with the tool beginning to unseat the manhole cover from the manhole). In use, the tool is preferably joined with the handle 20. More preferably, this is a fixed relationship, such as an end of the handle being sized to securely fit within a hole 16 in tool 10 and then be selectively fixed therein by a friction fit, a forced fit, and/or a close fit with a pin 24 located in and through the tool and the end of the handle 20 (as seen in FIG. 3, for example).

Tool 10 includes a body 30 extending from a front end 32 to a back end 34 and from a top edge 36 to a bottom edge 38. The body 30 includes a middle area 40 located between the front end 32 and the back end 34, and bounded by the top edge 36 and the bottom edge 38. The middle area is configured to be joinable to the handle and the handle selectively securable to the body in a fixed relationship, for example, as described previously via hole 16. The tool further includes the front end 32 of the body having a toe 60 extending away from the middle area 40. The toe includes a first vertical thickness 62 equal to a middle vertical thickness 42 of the middle area 40 where the toe 60 is joined to the middle area 40. Further, the toe includes a second vertical thickness 64 that is less than the first vertical thickness 62 for a length of the toe 60 extending away from the middle area 40. Further, the length can be any distance from right next to middle area 40, to outer tip 72 of the toe, and any distance in between, as long as any other features of the body, as desired, are satisfied.

The tool may also include, preferably, the back end 34 of the body having a heal pad 80 extending away from the middle area 40, with a first portion 82 of the bottom edge defined by the heal pad being offset a first vertical distance 84 from a second portion 44 of the bottom edge defined by the middle area to create a heal gap 86 between a bottom surface 88 of the heal pad and an imaginary line 46 formed by and extending parallel out from the second portion 44 of the bottom edge defined by the middle area. For example, and without being limited by a theory of understanding, I have discovered that the heal pad can better provide leverage, and preferably in combination with the handle, to operate the tool when lifting a heavy object, like a manhole cover. That said, the heal pad is not required to practice my tool, but it can definitely be an advantage when made a feature of the tool 10. Further in this regard, the heal gap can be important to helping create this leverage, and as such, is preferably at least about 0.25 inch and less than about 1 inch, more preferably is at least about ⅜ inch and less than about ⅞ inch and most preferably is at least about 7/16 inch and less than about 9/16 inch. Additionally, preferably the heal pad 80 has a heal horizontal width 98 that is greater than a middle area horizontal width 52. In this way, for example, this provides greater surface area for a user to step on and maneuver the tool, without the heal pad getting in the way of other use and operation of the tool. As another option, a front edge 81 of the heal pad can be flush with (not shown) or slightly set into (as shown) the adjoining portion of middle area 40, and formed from two separate components (as shown) that are fixedly secured together, and preferably permanently so once the tool is fully made. As yet a another option, heal pad 80 can include a foot ledge 89 that projects downwardly from the back end of pad 89 (as seen in FIG. 3). This can be a curved or straight sloped structure, that is bent therefrom or formed separately and attached thereto. Ledge 89 can provide added leverage to the user's foot to push or urge tool 10 in a direction away from the user's foot when needed, e.g., for inserting into or under the manhole cover or other structure being acted upon by tool 10.

The tool may also include, preferably, a fulcrum 100 joined to the body 30 and defining a fulcrum portion 102 of the bottom edge with the fulcrum 100 projecting away from the top edge 36. The fulcrum can be elongated and pin-like as seen in the figures, for example, or it could be less elongated and wider that it is long (not shown). Further, preferably, fulcrum portion 102 is offset a second vertical distance 104 from the second portion 44 of the bottom edge defined by the middle area to create a fulcrum gap 106 between a bottom surface 108 of the fulcrum 100 and the imaginary line 46 formed by and extending parallel out from the middle area of the bottom edge. Further in this regard, preferably, the fulcrum gap is at least about ½ inch and less than about 1.5 inches, more preferably is at least about % inch and less than about 1.25 inches and most preferably is at least about 1 inch. Additionally, or separately, another aspect of the fulcrum relates to its location on body 30, especially relative to the handle 20. In this regard, handle 20 has a circumference at its end where it is joinable to the middle area and this can be used to define a handle vertical circumferential projection 22 extending to and through the bottom edge of the body. With this understanding, preferably, at least a portion of the fulcrum 100 is located outside the handle vertical circumferential projection 22, and more preferably, all of the fulcrum 100 is located outside the handle vertical circumferential projection 22 (as seen in all the Figures, when visible). In a similar regard and for similar reasons, preferably, the fulcrum 100 is located closer to the toe 60 than to the heal pad 80. Again, and without being limited by a theory of understanding, I have discovered that the fulcrum can also better provide leverage, and preferably in combination with the handle, to operate the tool when lifting a heavy object, like a manhole cover. Further, the fulcrum can advantageously provide (i) a lifting pivot point to separate the manhole cover from the manhole, and (ii) a rotating pivot point to move and locate the manhole cover beside (or at least no longer over) the manhole so full access can be gained to the manhole.

In other aspects, tool 10 can include, preferably, certain features related to the bottom edge 38, which can enhance manufacturing ease of the tool and/or better operation of the tool. For example, the bottom edge can be flat in an end-to-end dimension 12, for at least a portion of it. As another example, additionally or alternately, the bottom edge can be flat in a side-to-side dimension, for at least a portion of it. As yet another example, more preferably, the bottom edge can be flat in the end-to-end dimension 12 for essentially an entirety of the bottom edge 38 except for the toe 60 or some portion of the toe. As still another example, more preferably, the bottom edge can be flat in end-to-end dimension 12 for essentially an entirety of the bottom edge except for the toe and the fulcrum (i.e., when the fulcrum is part of the tool). As another example still, additionally or alternately, an entirety of the length of the toe 60 except where the toe is joined to the middle area 40 is defined by the second vertical thickness 64, that is, thickness which is less than the middle vertical thickness for essentially the entire toe.

Considering other features of the tool, there is disclosed other, preferred, features related to the toe 60. For example, a toe portion 66 of the top edge can have a concave upward shape 68. More preferred in this regard, the toe portion 66 can have the concave upward shape 68 formed adjacent to a concave downward shape 70. Yet more preferred here, the toe portion 66 can have the downward shape 70 sandwiched between two toe portions each having the concave upward shape 68. As another example, and additionally or alternately, toe portion 66 of the top edge can have the concave upward shape 68 for an outer tip 72 of the toe. This can be particularly advantageous to aid in locating the toe of the tool into an opening in the manhole cover and under the cover for more secure movement of the cover thereafter. Further in this regard, even more preferably the second vertical thickness 64 at the outer tip 72 of the toe narrows to a sharp vertex 74.

Figure 6:
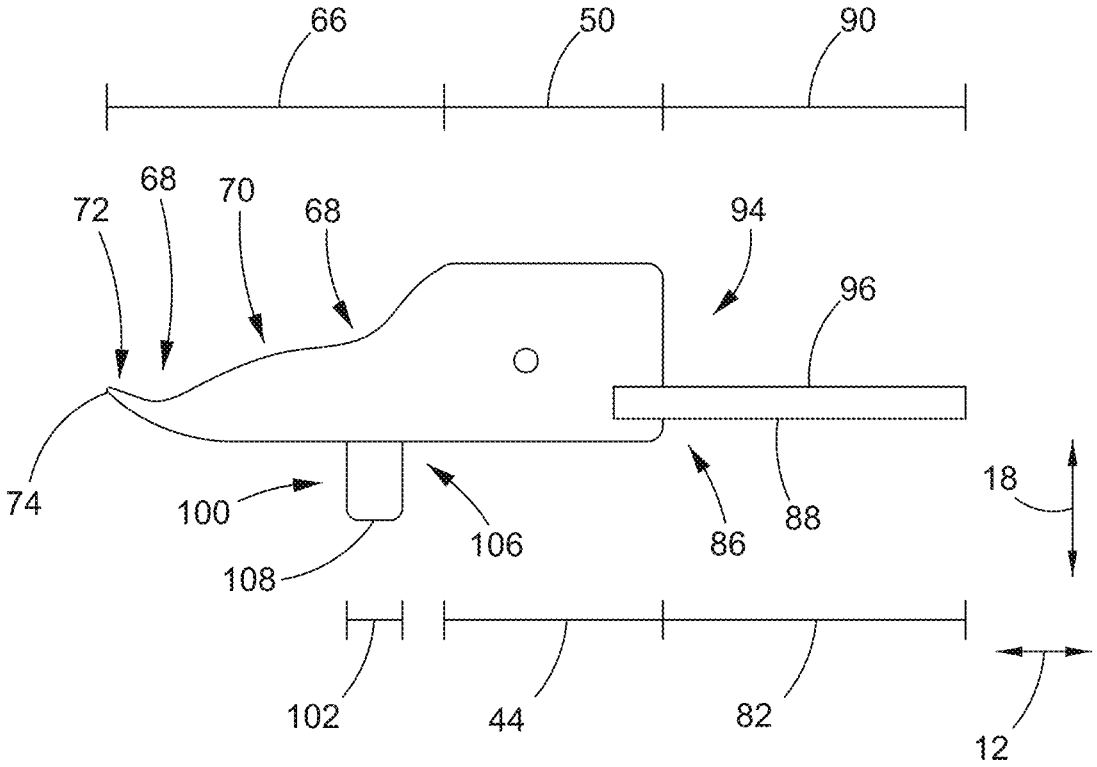
FIG. 6 is a left side view of that in FIG. 3 (without the foot ledge); and, FIG. 7 is a right side view of that in FIG. 3 (without the foot ledge).
Figure 7:
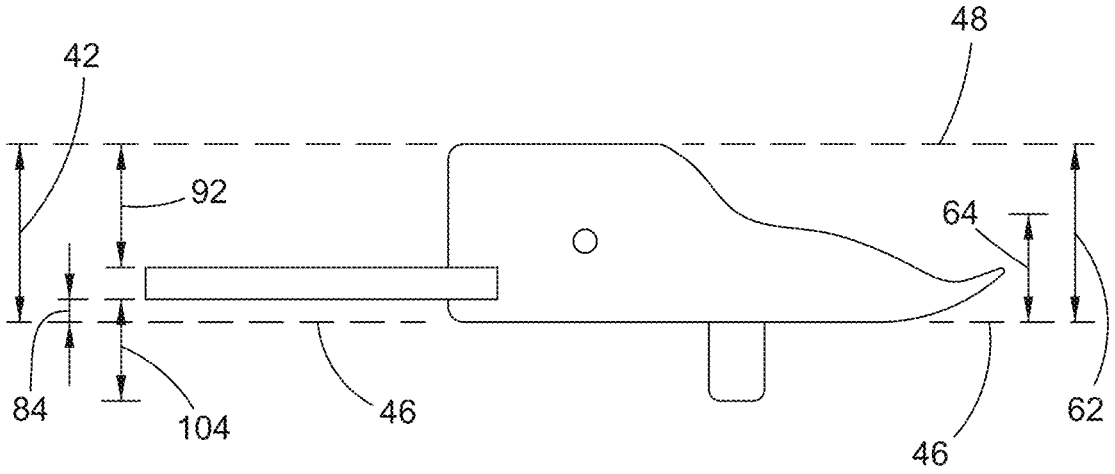

Turning to other features of the tool, advantages can be seen and are preferred, for the heal pad 80. For example, the heal pad can have a first portion 90 of the top edge defined by the heal pad being offset a second vertical distance 92 from a second portion 50 of the top edge defined by the middle area to create a second heal gap 94 between a top surface 96 of the heal pad and an imaginary line 48 formed by and extending parallel out from the middle area 40 of the top edge. As another example, and more preferred, the heal pad 80 can be located in the vertical dimension 18 between the imaginary line 48 formed by and extending parallel out from the middle area of the top edge 36 and the imaginary line 46 formed by and extending parallel out from the middle area of the bottom edge 38. As still another example, and even more preferred, the heal pad can extend outward from the middle portion in a horizontal orientation (as seen in FIGS. 6 and 7) that is substantially parallel to the imaginary line 48 formed by and extending parallel out from the middle area of the top edge and the imaginary line 46 formed by and extending parallel out from the middle area of the bottom edge.

Preferred dimensions of the tool are: a total length of about 10 to 14 inches, a width for the middle area and the toe of about 1 to 2 inches, a length of the heal pad of about 3 to 5 inches, and a width of the heal pad of about 2 to 5 inches. Conventional rigid materials can be used to make my tool, in conjunction with the teaching herein, for example, steel, aluminum, or other material compositions of sufficient strength as would be discerned by one of ordinary skill in the art in combination with the teachings herein, are preferred. And, the tool may be separate parts fixedly joined together or a single molded or formed structure with the various parts and features as described herein.

Additional discussion of embodiments in various scopes now follows:

A. A tool joinable with a handle to aid in moving a manhole cover from a manhole. The tool includes a body extending from a front end to a back end and from a top edge to a bottom edge. The body further includes a middle area located between the front end and the back end and bounded by the top edge and the bottom edge, with the middle area configured to be joinable to the handle and the handle selectively securable to the body in a fixed relationship. The front end of the body includes a toe extending away from the middle area. The toe includes (i) a first vertical thickness equal to a middle vertical thickness of the middle area where the toe is joined to the middle area, and (ii) a second vertical thickness less than the first vertical thickness for a length of the toe extending away from the middle area. The back end of the body includes a heal pad extending away from the middle area with a first portion of the bottom edge defined by the heal pad being offset a first vertical distance from a second portion of the bottom edge defined by the middle area to create a heal gap between a bottom surface of the heal pad and an imaginary line formed by and extending parallel out from the second portion of the bottom edge defined by the middle area.

B. A tool joinable with a handle. The tool includes a body extending from a front end to a back end and from a top edge to a bottom edge. The body includes a middle area located between the front end and the back end and bounded by the top edge and the bottom edge, with the middle area configured to be joinable to the handle and the handle selectively securable to the body in a fixed relationship. The front end of the body includes a toe extending away from the middle area. The toe includes (i) a first vertical thickness equal to a middle vertical thickness of the middle area where the toe is joined to the middle area, and (ii) a second vertical thickness less than the first vertical thickness for a length of the toe extending away from the middle area. The back end of the body includes a heal pad extending away from the middle area with a first portion of the bottom edge defined by the heal pad being offset a first vertical distance from a second portion of the bottom edge defined by the middle area to create a heal gap between a bottom surface of the heal pad and an imaginary line formed by and extending parallel out from the second portion of the bottom edge defined by the middle area. The bottom edge is flat in an end-to-end dimension for essentially an entirety of the bottom edge except for the toe and a toe portion of the top edge having a concave upward shape. A fulcrum is joined to the body and defining a fulcrum portion of the bottom edge with the fulcrum projecting away from the top edge.

C. A tool joinable with a handle. The tool includes a body extending from a front end to a back end and from a top edge to a bottom edge. The body includes a middle area located between the front end and the back end and bounded by the top edge and the bottom edge, with the middle area configured to be joinable to the handle and the handle selectively securable to the body in a fixed relationship. The front end of the body includes a toe extending away from the middle area. The toe includes (i) a first vertical thickness equal to a middle vertical thickness of the middle area where the toe is joined to the middle area, and (ii) a second vertical thickness less than the first vertical thickness for a length of the toe extending away from the middle area. A fulcrum is joined to the body and defining a fulcrum portion of the bottom edge with the fulcrum projecting away from the top edge. The fulcrum portion is offset a second vertical distance from the second portion of the bottom edge defined by the middle area to create a fulcrum gap between a bottom surface of the fulcrum and the imaginary line formed by and extending parallel out from the middle area of the bottom edge.

D. The tool of any of the prior embodiments, wherein an entirety of the length of the toe except where the toe is joined to the middle area is defined by the second vertical thickness.

E. The tool of any of the prior embodiments, wherein the bottom edge is flat in a end-to-end dimension.

F. The tool of any of the prior embodiments, wherein the bottom edge is flat in a side-to-side dimension.

G. The tool of any of the prior embodiments, wherein the bottom edge is flat in the end-to-end dimension for essentially an entirety of the bottom edge except for the toe.

H. The tool of any of the prior embodiments, further comprising a toe portion of the top edge having a concave upward shape.

I. The tool of any of the prior embodiments, further comprising the toe portion of the top edge having the concave upward shape formed adjacent to a concave downward shape.

J. The tool of any of the prior embodiments, further comprising the toe portion of the top edge having the downward shape sandwiched between two toe portions each having the concave upward shape.

K. The tool of any of the prior embodiments, further comprising a toe portion of the top edge having a concave upward shape for an outer tip of the toe.

L. The tool of any of the prior embodiments, wherein the second vertical thickness at the outer tip of the toe narrows to a sharp vertex.

M. The tool of any of the prior embodiments, further comprising a fulcrum joined to the body and defining a fulcrum portion of the bottom edge with the fulcrum projecting away from the top edge.

N. The tool of any of the prior embodiments, wherein the fulcrum portion is offset a second vertical distance from the second portion of the bottom edge defined by the middle area to create a fulcrum gap between a bottom surface of the fulcrum and the imaginary line formed by and extending parallel out from the middle area of the bottom edge.

O. The tool of any of the prior embodiments, wherein the fulcrum gap is at least about ½ inch and less than about 1.5 inches.

P. The tool of any of the prior embodiments, wherein the handle has a circumference where it is joinable to the middle area and defines a handle vertical circumferential projection extending to and through the bottom edge of the body, and at least a portion of the fulcrum is located outside the handle vertical circumferential projection.

Q. The tool of any of the prior embodiments, wherein the fulcrum is located closer to the toe than to the heal pad.

R. The tool of any of the prior embodiments, wherein the fulcrum is located closer to the toe than to the heal pad.

S. The tool of any of the prior embodiments, wherein the bottom edge is flat in an end-to-end dimension for essentially an entirety of the bottom edge except for the toe and the fulcrum.

T. The tool of any of the prior embodiments, wherein the handle is fixedly joined with the tool.

U. The tool of any of the prior embodiments, further comprising the heal pad with a first portion of the top edge defined by the heal pad being offset a second vertical distance from a second portion of the top edge defined by the middle area to create a second heal gap between a top surface of the heal pad and an imaginary line formed by and extending parallel out from the middle area of the top edge.

V. The tool of any of the prior embodiments, wherein the heal pad is located in a vertical dimension between the imaginary line formed by and extending parallel out from the middle area of the top edge and the imaginary line formed by and extending parallel out from the middle area of the bottom edge.

W. The tool of any of the prior embodiments, wherein the heal pad extends outward from the middle portion in a horizontal orientation that is substantially parallel to the imaginary line formed by and extending parallel out from the middle area of the top edge and the imaginary line formed by and extending parallel out from the middle area of the bottom edge.

X. The tool of any of the prior embodiments, wherein the heal gap is at least about ¼ inch and less than about 1 inch.

Y. The tool of any of the prior embodiments, wherein the heal pad has a heal horizontal width that is greater than a middle area horizontal width.

Each and every document cited in this present application, including any cross referenced or related patent or application, is incorporated in this present application in its entirety by this reference, unless expressly excluded or otherwise limited. The citation of any document is not an admission that it is prior art with respect to any embodiment disclosed in this present application or that it alone, or in any combination with any other reference or references, teaches, suggests, or discloses any such embodiment. Further, to the extent that any meaning or definition of a term in this present application conflicts with any meaning or definition of the same term in a document incorporated by reference, the meaning or definition assigned to that term in this present application governs.

The present invention includes the description, examples, embodiments, and drawings disclosed; but it is not limited to such description, examples, embodiments, or drawings. As briefly described above, the reader should assume that features of one disclosed embodiment can also be applied to all other disclosed embodiments, unless expressly indicated to the contrary. Unless expressly indicated to the contrary, the numerical parameters set forth in the present application are approximations that can vary depending on the desired properties sought to be obtained by a person of ordinary skill in the art without undue experimentation using the teachings disclosed in the present application. Modifications and other embodiments will be apparent to a person of ordinary skill in the applicable mechanical tools arts, and all such modifications and other embodiments are intended and deemed to be within the scope of the present invention.

What is claimed is:

1. A tool joinable with a handle to aid in moving a manhole cover from a manhole, the tool comprising:

a body extending from a front end to a back end and from a top edge to a bottom edge, the body including a middle area located between the front end and the back end and bounded by the top edge and the bottom edge, with the middle area configured to be joinable to the handle and the handle selectively securable to the body in a fixed relationship;

the front end of the body including a toe extending away from the middle area and the toe including:

(i) a first vertical thickness equal to a middle vertical thickness of the middle area where the toe is joined to the middle area, and (ii) a second vertical thickness less than the first vertical thickness for a length of the toe extending away from the middle area;

the back end of the body including a heal pad extending away from the middle area with a first portion of the bottom edge defined by the heal pad being offset a first vertical distance from a second portion of the bottom edge defined by the middle area to create a heal gap between a bottom surface of the heal pad and an imaginary line formed by and extending parallel out from the second portion of the bottom edge defined by the middle area, wherein the heal pad has a flat step on surface with a heal horizontal width that is greater than a width of the middle area; and, a fulcrum joined to the body and defining a fulcrum portion of the bottom edge with the fulcrum projecting away from the top edge, wherein the handle has a circumference where it is joinable to the middle area and defines a handle vertical circumferential projection extending to and through the bottom edge of the body, and the fulcrum is offset from the handle vertical circumferential projection.

2. The tool of claim 1, wherein an entirety of the length of the toe except where the toe is joined to the middle area is defined by the second vertical thickness.

3. The tool of claim 1, wherein the bottom edge is flat in an end-to-end dimension.

4. The tool of claim 3, wherein the bottom edge is flat in a side-to-side dimension.

5. The tool of claim 3, wherein the bottom edge is flat in the end-to-end dimension for essentially an entirety of the bottom edge except for the toe.

6. The tool of claim 5, further comprising a toe portion of the top edge having a concave upward shape for an outer tip of the toe.

7. The tool of claim 6, wherein the second vertical thickness at the outer tip of the toe narrows to a sharp vertex.

8. The tool of claim 1, further comprising a toe portion of the top edge having a concave upward shape.

9. The tool of claim 8, further comprising the toe portion of the top edge having the concave upward shape formed adjacent to a concave downward shape.

10. The tool of claim 9, further comprising the toe portion of the top edge having the concave downward shape sandwiched between two toe portions each having the concave upward shape.

11. The tool of claim 1, wherein the fulcrum portion is offset a second vertical distance from the second portion of the bottom edge defined by the middle area to create a fulcrum gap between a bottom surface of the fulcrum and the imaginary line formed by and extending parallel out from the middle area of the bottom edge.

12. The tool of claim 11, wherein the fulcrum gap is at least about ½ inch and less than about 1.5 inches.

13. The tool of claim 1, wherein the fulcrum is located closer to the toe than to the heal pad.

14. The tool of claim 1, wherein the bottom edge is flat in an end-to-end dimension for essentially an entirety of the bottom edge except for the toe and the fulcrum.

15. The tool of claim 1, wherein the handle is fixedly joined with the tool.

16. The tool of claim 1 further comprising the heal pad with a first portion of the top edge defined by the heal pad being offset a second vertical distance from a second portion of the top edge defined by the middle area to create a second heal gap between a top surface of the heal pad and an imaginary line formed by and extending parallel out from the middle area of the top edge.

17. The tool of claim 16, wherein the heal pad is located in a vertical dimension between the imaginary line formed by and extending parallel out from the middle area of the top edge and the imaginary line formed by and extending parallel out from the middle area of the bottom edge.

18. The tool of claim 17, wherein the heal pad extends outward from the middle portion in a horizontal orientation that is substantially parallel to the imaginary line formed by and extending parallel out from the middle area of the top edge and the imaginary line formed by and extending parallel out from the middle area of the bottom edge.

19. The tool of claim 1, wherein the heal gap is about ¼ inch and less than about 1 inch.

20. The tool of claim 1, wherein the heal pad has a heal horizontal width that is greater than a middle area horizontal width.

21. The tool of claim 1, wherein the fulcrum engages the manhole when moving the manhole cover from the manhole.

22. A tool joinable with a handle, the tool comprising:

a body extending from a front end to a back end and from a top edge to a bottom edge, the body including a middle area located between the front end and the back end and bounded by the top edge and the bottom edge, with the middle area configured to be joinable to the handle and the handle selectively securable to the body in a fixed relationship, the front end of the body including a toe extending away from the middle area and the toe including:

(i) a first vertical thickness equal to a middle vertical thickness of the middle area where the toe is joined to the middle area, and (ii) a second vertical thickness less than the first vertical thickness for a length of the toe extending away from the middle area;

the back end of the body including a heal pad extending away from the middle area with a first portion of the bottom edge defined by the heal pad being offset a first vertical distance from a second portion of the bottom edge defined by the middle area to create a heal gap between a bottom surface of the heal pad and an imaginary line formed by and extending parallel out from the second portion of the bottom edge defined by the middle area, wherein the heal pad has a flat step on surface with a heal horizontal width that is greater than a width of the middle area;

the bottom edge is flat in an end-to-end dimension for essentially an entirety of the bottom edge except for the toe and a toe portion of the top edge having a concave upward shape; and, a fulcrum joined to the body and defining a fulcrum portion of the bottom edge with the fulcrum projecting away from the top edge, wherein the handle has a circumference where it is joinable to the middle area and defines a handle vertical circumferential projection extending to and through the bottom edge of the body, and the fulcrum is offset from the handle vertical circumferential projection.

23. The tool of claim 21, further comprising a manhole cover seated in a manhole and wherein the fulcrum engages the manhole when moving the manhole cover from the manhole.

24. A tool joinable with a handle, the tool comprising:

a body extending from a front end to a back end and from a top edge to a bottom edge, the body including a middle area located between the front end and the back end and bounded by the top edge and the bottom edge, with the middle area configured to be joinable to the handle and the handle selectively securable to the body in a fixed relationship;

the front end of the body including a toe extending away from the middle area and the toe including:

(i) a first vertical thickness equal to a middle vertical thickness of the middle area where the toe is joined to the middle area, and (ii) a second vertical thickness less than the first vertical thickness for a length of the toe extending away from the middle area;

a fulcrum joined to the body and defining a fulcrum portion of the bottom edge with the fulcrum projecting away from the top edge and the fulcrum portion is offset a second vertical distance from the second portion of the bottom edge defined by the middle area to create a fulcrum gap between a bottom surface of the fulcrum and the imaginary line formed by and extending parallel out from the middle area of the bottom edge the back end of the body including a heal pad extending away from the middle area, the heal pad has a flat step on surface; and wherein the fulcrum is offset from a handle vertical circumferential projection and located closer to the toe than to the heal pad and wherein the fulcrum is spaced from the handle vertical circumferential projection.

25. The tool of claim 24, further comprising a manhole cover seated in a manhole and wherein the fulcrum engages the manhole when moving the manhole cover from the manhole.

* * * * *